US009239057B2

(12) United States Patent
Hoshi et al.

(10) Patent No.: US 9,239,057 B2
(45) Date of Patent: Jan. 19, 2016

(54) PUMP CONFIGURATION

(71) Applicant: MITSUBISHI HEAVY INDUSTRIES, LTD., Tokyo (JP)

(72) Inventors: Hideo Hoshi, Tokyo (JP); Shogo Nakashima, Tokyo (JP); Tatsuya Hidaka, Tokyo (JP); Yasuharu Yamamoto, Tokyo (JP); Takeshi Okubo, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/570,181

(22) Filed: Dec. 15, 2014

(65) Prior Publication Data

US 2015/0110652 A1 Apr. 23, 2015

Related U.S. Application Data

(63) Continuation of application No. 13/825,066, filed as application No. PCT/JP2012/052892 on Feb. 8, 2012.

(30) Foreign Application Priority Data

Feb. 10, 2011 (JP) ..... 2011-027764

(51) Int. Cl.
*F04B 17/03* (2006.01)
*F04B 35/04* (2006.01)
(Continued)

(52) U.S. Cl.
CPC ..... *F04D 13/024* (2013.01); *F04D 13/02* (2013.01); *F04D 13/06* (2013.01); *F04D 13/0606* (2013.01); *F04D 29/628* (2013.01)

(58) Field of Classification Search
CPC ... F04D 13/024; F04D 13/025; F04D 29/628; F04D 29/62; F04D 29/605; F04D 29/607; F04D 29/606
USPC ..... 417/360, 420, 423.1, 424.2; 403/348, 403/349
See application file for complete search history.

(56) References Cited

U.S. PATENT DOCUMENTS 2,810,349 A * 10/1957 Zozulin ..... H02K 49/04 188/264 P
2,956,734 A * 10/1960 Doyle ..... A47L 5/365 15/327.1

(Continued)

FOREIGN PATENT DOCUMENTS

CN 101709711 5/2010
CN 101842968 9/2010

(Continued)

OTHER PUBLICATIONS

Official Action issued Aug. 19, 2014 in corresponding U.S. Appl. No. 13/825,066.

(Continued)

*Primary Examiner* — Alexander Comley
(74) *Attorney, Agent, or Firm* — Wenderoth, Lind & Ponack, L.L.P.

(57) ABSTRACT

A magnetic-drive coupling pump configuration including an attachment/detachment mechanism allowing simple and reliable positioning and fixation is provided. Thrust-direction positioning and radial-direction positioning are achieved, respectively, by surface contact of a convex portion of a pump unit (10) inserted up to a predetermined position in a concave portion (31) of a drive motor unit (30), and contact between an outer circumferential surface of the convex portion (11) and an inner circumferential surface of the concave portion (31). A claw (15) protruding on the outer circumferential surface of the pump unit (10), an engaging portion (32) protruding upward from an upper outer circumferential portion of the drive motor unit (30) to restrict, by engagement, claw upward movement when the pump unit (10) is rotated with the convex portion (11) inserted up to the predetermined position in the concave portion (31), and a locking mechanism (50) holding the pump unit (10) at an engagement position of the claw (15) and the engaging portion (32) are included.

4 Claims, 11 Drawing Sheets

(51) Int. Cl.

| | |
|---|---|
| ***F04D 13/02*** | (2006.01) |
| ***F04D 13/06*** | (2006.01) |
| ***F04D 29/62*** | (2006.01) |

(56) References Cited

U.S. PATENT DOCUMENTS 3,411,450 A * 11/1968 Clifton ..... F04D 13/024 310/104
3,802,804 A * 4/1974 Zimmermann ..... F04D 7/06 417/360
3,826,938 A * 7/1974 Filer ..... F04D 13/027 310/104
3,932,068 A * 1/1976 Zimmermann ..... F04D 29/026 310/104
4,013,384 A * 3/1977 Oikawa ..... F04D 3/02 415/10
4,049,364 A * 9/1977 Ross ..... B41F 31/02 403/301
4,103,511 A * 8/1978 Kress ..... B25F 3/00 29/560
4,304,532 A * 12/1981 McCoy ..... F16J 15/50 310/104
4,403,923 A * 9/1983 Korchin ..... F04D 29/607 417/360
4,487,557 A * 12/1984 Ruyak ..... H02K 49/106 310/104
4,589,822 A * 5/1986 Clausen ..... A61M 1/101 277/397
4,606,698 A * 8/1986 Clausen ..... A61M 1/101 277/328
4,898,518 A * 2/1990 Hubbard ..... A61M 1/101 415/230
4,917,525 A * 4/1990 Duncan ..... H01R 13/625 285/93
4,984,972 A * 1/1991 Clausen ..... A61M 1/101 415/900
4,998,863 A * 3/1991 Klaus ..... F04D 15/0263 417/420
5,021,048 A * 6/1991 Buckholtz ..... A61M 1/101 415/900
5,044,883 A * 9/1991 Neueder ..... F01P 5/10 415/201
5,045,026 A * 9/1991 Buse ..... F04D 13/024 417/360
5,269,664 A * 12/1993 Buse ..... F04D 29/061 417/360
5,360,317 A * 11/1994 Clausen ..... A61M 1/101 415/206
5,404,614 A * 4/1995 Stephens ..... A47L 5/365 15/327.2
5,575,630 A * 11/1996 Nakazawa ..... A61M 1/101 415/900
5,580,216 A * 12/1996 Munsch ..... F04D 29/0413 415/122.1
5,658,136 A * 8/1997 Mendler ..... A61M 1/1036 417/420
6,045,340 A * 4/2000 Batchelder ..... F04D 29/426 417/360
6,152,704 A * 11/2000 Aboul-Hosn ..... A61M 1/101 417/360
6,179,581 B1 * 1/2001 Schnittger ..... F04C 15/0057 417/302
6,558,139 B2 * 5/2003 Nguyen ..... F04D 7/02 415/229
6,607,370 B2 * 8/2003 Fukamachi ..... F04D 13/027 417/420
7,137,794 B2 11/2006 Pfetzer et al.
7,500,829 B2 * 3/2009 Edwards ..... F04D 29/026 416/170 R
8,074,321 B2 12/2011 Fry et al.
8,114,008 B2 2/2012 Hidaka et al.
2004/0071573 A1 * 4/2004 Pfetzer ..... F04D 29/086 417/423.15
2004/0184936 A1 * 9/2004 Yanagihara ..... F04D 13/025 417/420
2006/0191099 A1 * 8/2006 Fry ..... A47L 5/225 15/353
2006/0222533 A1 * 10/2006 Reeves ..... A61M 1/101 417/420
2010/0280305 A1 * 11/2010 Hidaka ..... A61M 1/101 600/16
2014/0234141 A1 8/2014 Hoshi et al.

FOREIGN PATENT DOCUMENTS

| | | |
|---|---|---|
| JP | 3-286775 | 12/1991 |
| JP | 2001-90687 | 4/2001 |
| JP | 2005-517126 | 6/2005 |
| JP | 2009-197736 | 9/2009 |

OTHER PUBLICATIONS

Notice of Allowance and Fee(s) Due issued Oct. 30, 2014 in corresponding U.S. Appl. No. 13/825,066.
Office Action issued Dec. 3, 2014 in corresponding Chinese patent application No. 201280002586.4 (with English translation).
International Search Report issued May 15, 2012 in International Application No. PCT/JP2012/052892.
Written Opinion of the International Searching Authority issued May 15, 2012 in International Application No. PCT/JP2012/052892.
Decision to Grant a Patent issued Aug. 20, 2013 in corresponding Japanese patent application No. 2012-551015.
Decision to Grant a Patent issued Aug. 5, 2015 in corresponding Chinese patent application No. 201280002586.4 (with English translation).

* cited by examiner

PUMP CONFIGURATION

This application is a divisional of application Ser. No. 13/825,066, which is the National Stage of International Application No. PCT/JP2012/052892, filed Feb. 8, 2012.

TECHNICAL FIELD

The present invention relates to a magnetic drive pump configuration that can be divided into a pump unit and a drive motor unit, and more particularly, to a coupling pump configuration assembled by inserting a pump unit on which an impeller is supported by a non-contact bearing into a drive motor unit.

BACKGROUND ART

Conventionally, a magnetic drive pump configuration is known that applies pressure on liquid by rotating an impeller by magnetic force.

With such a magnetic drive pump configuration, an impeller having an inner magnet (a driven magnet) is accommodated in a pump unit, and is rotatably supported via a non-contact bearing such as a magnetic bearing or a hydrodynamic bearing. Also, the impeller accommodated in the pump unit is not driven by a shaft coupled to a drive motor, but is indirectly driven while separated from a drive source, by the use of magnetic force (attraction force of the magnet).

Accordingly, a drive motor unit accommodating an outer magnet (a driving magnet) that rotates together with a drive motor is configured separately from the pump unit accommodating the impeller to which the inner magnet, which is to be attracted to the outer magnet, is attached. That is, the pump unit and the drive motor unit described above have separate casings, rendering a pump configuration according to which a coupling portion such as a drive shaft, for example, is not present in a drive mechanism for transmitting power for rotating the impeller.

By adopting the magnetic driving described above, an assembly configuration where the pump unit is inserted into a concave portion of the drive motor unit and the two are integrated by a screw or a detent is achieved, and this integrated configuration is referred to as a coupling pump configuration. In this case, the outer magnet is provided to a concave casing formed on the drive motor unit, and the inner magnet is provided to a convex casing formed on the pump unit.

Additionally, magnetic force in the direction of drawing the pump unit into the drive motor unit acts between the pump unit and the drive motor unit.

Furthermore, PTL 1 mentioned below discloses a blood pump which can be separated into a pump chamber and a magnet housing chamber so as to enable incineration of the pump chamber to thereby produce almost no ash. In this case, when a rotary body and a drive shaft in the magnet housing chamber are rotated, since the drive shaft is coupled to a rotating shaft by a joint, an impeller rotates together with the drive shaft and the rotating shaft. That is, according to the pump configuration disclosed in PTL 1, an impeller inside the pump chamber is coupled to a drive unit inside the magnet housing chamber by a shaft.

CITATION LIST

Patent Literature

{PTL 1}
Japanese Unexamined Patent Application, Publication No. 2001-90687

SUMMARY OF INVENTION

Technical Problem

Now, with the magnetic-drive coupling pump configuration described above, since the pump unit and the drive motor unit are integrated by a screw or a detent and magnetic force, the pump unit being used may unintentionally fall off the drive motor unit. That is, with a conventional integrated configuration, there is a problem that the reliability is low.

Furthermore, depending on the use of the pump, the magnetic-drive coupling pump configuration described above is required to enable the pump unit to be swiftly attached to the drive motor unit and to become usable. Accordingly, a pump configuration is desired that enables a pump unit to be reliably and accurately fixed to a drive motor unit even when the pump unit is quickly attached.

Also, with a conventional configuration where integration is achieved by a screw or a detent and magnetic force, the positional relationship between a pump unit and a drive motor unit is not constant and is unreliable in accuracy, thus leading to the problem in the pump properties (rotational accuracy of an impeller), the hydrodynamic levitation performance and magnetic levitation performance of the impeller, and durability in the case of using a pivot bearing to support rotation of the impeller.

In view of the background, an attachment/detachment mechanism is desired, with respect to the magnetic-drive coupling pump configuration, according to which a pump unit and a drive motor unit are integrated, and simple and reliable positioning and fixation are enabled.

The present invention is made in view of the above circumstances, and its object is to provide a magnetic-drive coupling pump configuration which includes an attachment/detachment mechanism allowing simple and reliable positioning and fixation.

Solution to Problem

The present invention provides the following solutions to solve the problems mentioned above.

A pump configuration according to the present invention is a magnetic drive pump configuration which is a coupling type that inserts a convex portion provided on a bottom surface of a pump unit into a concave portion provided on a top surface of a drive motor unit to achieve integration, and according to which magnetic force generated between a driven magnet attached to an impeller that rotates by a non-contact bearing inside the pump unit, and a driving magnet that rotates by a motor inside the drive motor unit rotates the impeller and applies pressure on liquid, wherein positioning in a thrust direction is achieved by the bottom surface of the pump unit and a top surface of the drive motor unit that are in surface contact with each other in a state where the convex portion is inserted up to a predetermined position in the concave portion, and positioning in a radial direction is achieved by a contact between an outer circumferential surface of the convex portion and an inner circumferential surface of the concave portion, and wherein the pump configuration includes a plurality of claws provided in a protruding manner on the outer circumferential surface of the pump unit, a plurality of engaging portions provided upward and in a protruding manner from an upper outer circumferential portion of the drive motor unit to restrict upward movement of the claws by coming into engagement when the pump unit is rotated in a state where the convex portion is inserted up to a predetermined position in the concave portion, and a locking mechanism for holding the pump unit at an engagement position of the claws and the engaging portions.

According to the pump configuration of the present invention, positioning in the thrust direction is achieved by the bottom surface of the pump unit and the top surface of the drive motor unit that are in surface contact with each other in a state where the convex portion is inserted up to a predetermined position in the concave portion, and positioning in the radial direction is achieved by a contact between the outer circumferential surface of the convex portion and the inner circumferential surface of the concave portion, and a plurality of claws provided in a protruding manner on the outer circumferential surface of the pump unit, a plurality of engaging portions provided upward and in a protruding manner from the upper outer circumferential portion of the drive motor unit to restrict upward movement of the claws by coming into engagement when the pump unit is rotated in a state where the convex portion is inserted up to a predetermined position in the concave portion, and the locking mechanism for holding the pump unit at an engagement position of the claws and the engaging portions are included. Therefore, if an assembly operation of rotating the pump unit after inserting the convex portion of the pump unit into the concave portion of the drive motor unit is performed, the upward movement of the pump unit is restricted by the engagement of the claws and the engaging portions, and is held at the engagement position by the locking mechanism. As a result, reliable and swift positioning and fixation of the pump unit with respect to a predetermined position of the drive motor unit by a simple assembly operation of inserting the convex portion of the pump unit into the concave portion of the drive motor unit and rotating is enabled.

In the invention described above, the locking mechanism preferably includes an engaging protrusion member having a guide engagement surface, formed on an outer circumferential edge surface protruding outward from the pump unit, that starts as a sloping surface whose protrusion amount increases in an opposite direction from an attachment rotation direction to be a step, and a movable arm having an arm main body that is supported, at around a middle portion, on an outer circumferential surface of the drive motor unit and that is swingable in a pump radial direction on a vertical plane, an elastic member that biases inward an upper end portion of the arm main body in the pump radial direction, a concave portion that is provided at the upper end portion of the arm main body and that engages with the engaging protrusion member, and a guide wall that causes the arm main body to swing by contacting the sloping surface and that applies a detent on the pump unit by engaging with the step.

With the pump configuration including such a locking mechanism, the arm main body whose guide wall is in contact with the sloping surface will have the guide wall pushed outward along the sloping surface when the pump unit whose convex portion is inserted into the concave portion of the drive motor unit is rotated in the attachment rotation direction. As a result, the movable arm overwhelms the bias of the elastic member and opens outward on a vertical plane, and when the guide wall passes the sloping surface and reaches the step, the movable arm is closed inward by the bias of the elastic member.

With the rotational operation of the pump unit and the operation of the movable arm described above, the locking mechanism achieves a detent, at the position of engagement of the claws and the engaging portions, by the engagement of the step of the movable arm supported on the drive motor unit side and the guide wall formed on the engaging protrusion member of the pump unit side, and falls into a locked state where the pump unit is held at a predetermined assembly position. In this locked state, the movable arm is biased inward in the pump radial direction by the elastic member, and the engaging protrusion member is engaged with the concave portion, and thus, the pump unit is not removed from the drive motor unit unless an operator intentionally releases the locked state of the movable arm.

In this state, the locking mechanism preferably includes a stopper that restricts rotation of the pump unit in the attachment rotation direction, and this will enable the rotation of the pump unit, at the time of attachment, to be stopped at a predetermined position by the stopper, and a detent to be applied on the pump unit in the locked state in both directions.

In the invention described above, the locking mechanism preferably includes an arm main body that is supported, at around a middle portion, on a base provided in a protruding manner from an outer circumferential surface of the drive motor unit and that is swingable in a pump radial direction on a horizontal plane, an elastic member that biases inward an engaging tip end portion side of the arm main body in the pump radial direction, an engaging surface that is provided at the engaging tip end portion side of the arm main body and that applies a detent on the pump unit in an opposite direction of an attachment rotation direction, and a guide surface that, at a time of attachment rotation of the pump unit, causes the engaging tip end portion side of the arm main body to move outward in the pump radial direction by contacting the claws.

According to the pump configuration including such a locking mechanism, the arm main body whose guide surface is in contact (in engagement) with the claw has the guide surface pushed outward and the engaging tip end portion side moved outward in the pump radial direction when the pump unit whose convex portion is inserted into the concave portion of the drive motor unit is rotated in the attachment rotation direction. As a result, the arm main body overwhelms the bias of the elastic member and opens outward on a horizontal plane, and when the claw passes the guide surface and reaches the engaging surface, the arm main body is closed inward by the bias of the elastic member.

The guide surface in this case is preferably a curved or flat sloping surface, but it is not limited to such as long as the inward protrusion amount is increased continuously or stepwisely in the attachment rotation direction of the pump unit.

With the rotational operation of the pump unit and the operation of the arm main body described above, the locking mechanism achieves a detent, at the position of engagement of the claws and the engaging portions, by the engagement of the engagement surface of the arm main body supported on the drive motor unit side and the claw on the pump unit side, and falls into a locked state where the pump unit is held at a predetermined assembly position. In this locked state, the arm main body is biased inward in the pump radial direction by the elastic member, and the pump unit is not removed from the drive motor unit unless an operator intentionally releases the locked state of the arm main body.

Also in this state, the locking mechanism preferably includes a stopper that restricts rotation of the pump unit in the attachment rotation direction, and this will enable the rotation of the pump unit, at the time of attachment, to be stopped at a predetermined position by the stopper, and a detent to be applied on the pump unit in the locked state in both directions.

In the invention described above, a passage is preferably provided between the convex portion provided on the bottom surface of the pump unit and the concave portion provided on the top surface of the drive motor unit, to cause air to circulate at a time of attachment/detachment, and this will allow air to move through the passage at the time of attachment or detachment, thus enabling the pump unit to be smoothly attached or detached to or from the drive motor unit.

In the invention described above, a fitting dimensional tolerance allowed between the convex portion of the pump unit and the concave portion of the drive motor unit is preferably set to be smaller than a fitting dimensional tolerance for the non-contact bearing accommodated inside the pump unit, and this will prevent a shaft misalignment of the non-contact bearing and enable smooth rotation of the impeller.

Advantageous Effects of Invention

According to the pump configuration of the present invention described above, when the convex portion of the pump unit is inserted into the concave portion of the drive motor unit and is rotated, positioning of the pump unit and the drive motor unit in the thrust direction and the radial direction is performed, and also, the locking mechanism automatically operates to apply a detent and fix the pump unit, and thus, the magnetic-drive coupling pump configuration will include an attachment/detachment mechanism allowing simple, reliable and swift positioning and fixation.

DESCRIPTION OF EMBODIMENTS

Figure 1:
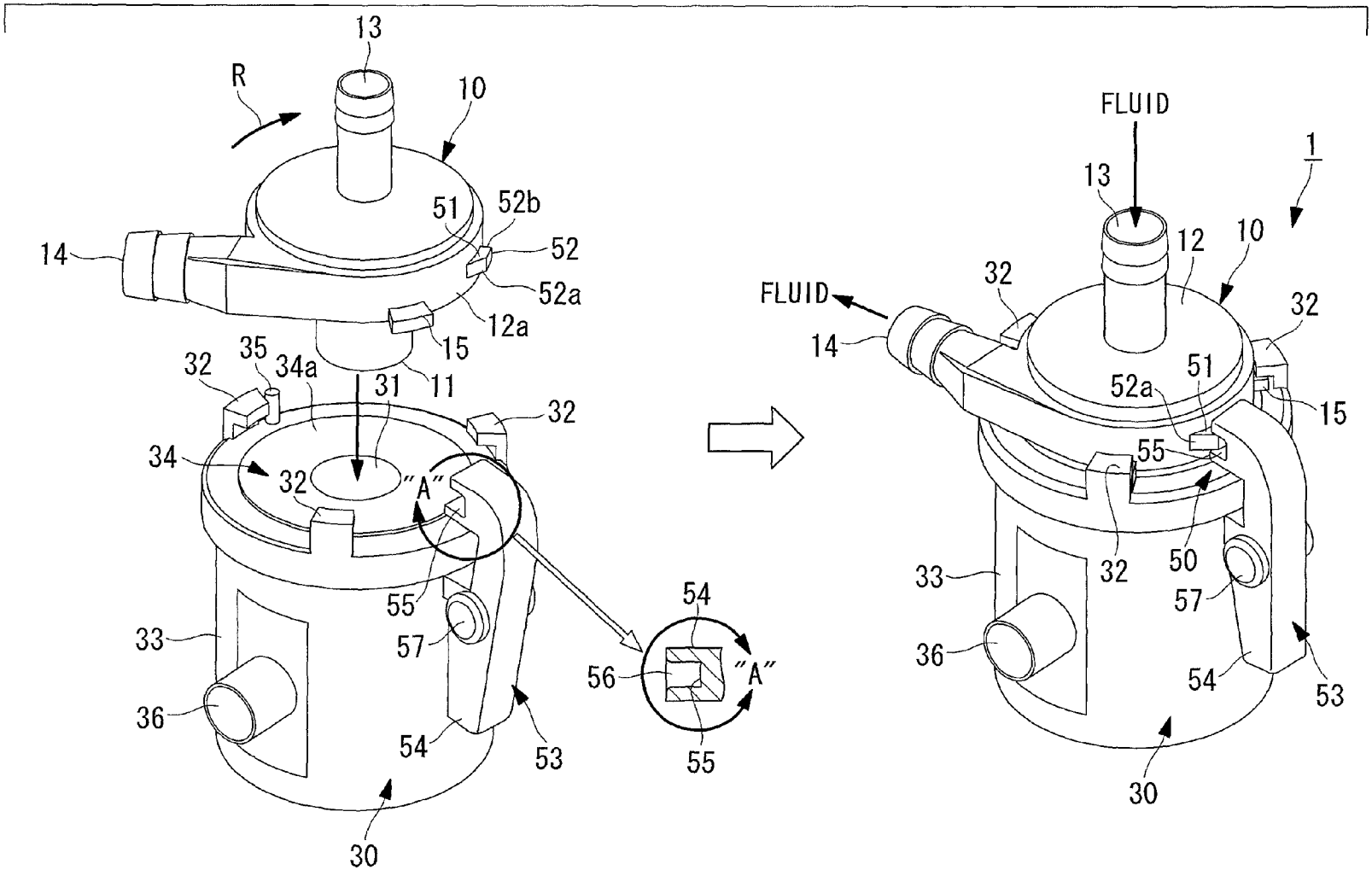
FIG. 1 is a view showing an embodiment (a first example) of a pump configuration according to the present invention, and is a perspective view showing a state before assembly where a pump unit and a drive motor unit are not yet integrated (left side on the page) and a state after assembly where they are integrated (right side on the page).
Figure 2:
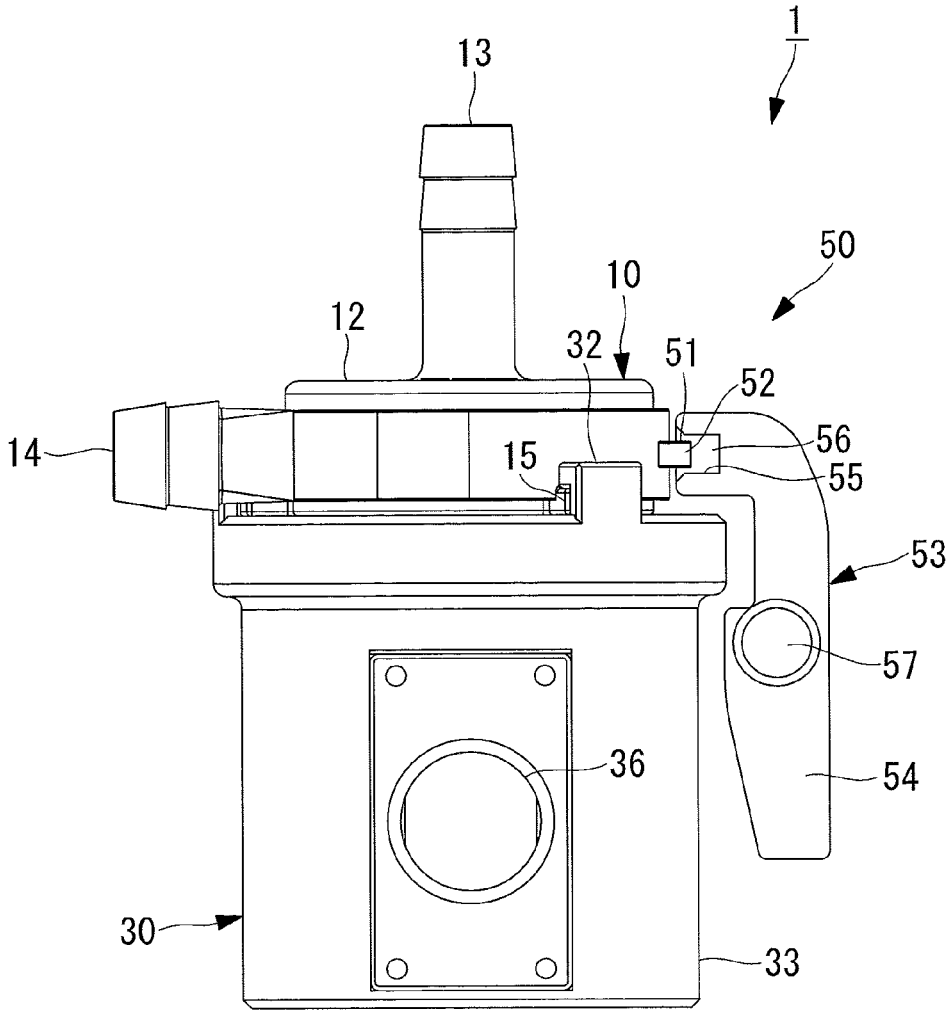
FIG. 2 is a front view showing the pump configuration after assembly shown on the right side on the page in FIG. 1.
Figure 3:
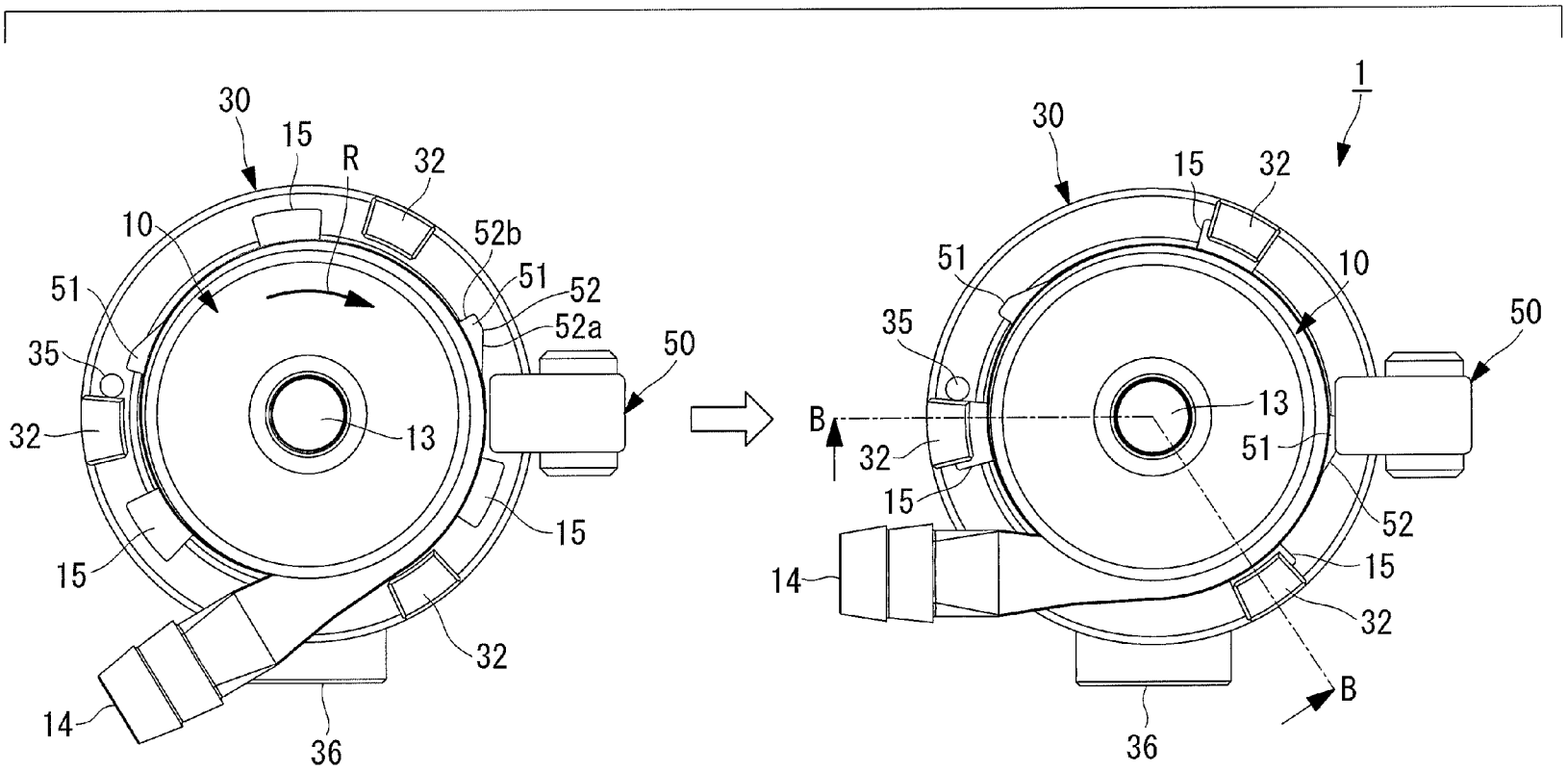
FIG. 3 is an explanatory view showing an operation of rotating, and integrating, a pump unit inserted into a concave portion of a drive motor unit, and the left side on the page is a state before completion of assembly and the right side on the page is a state after completion of assembly (a plan view of FIG. 2).
Figure 4:
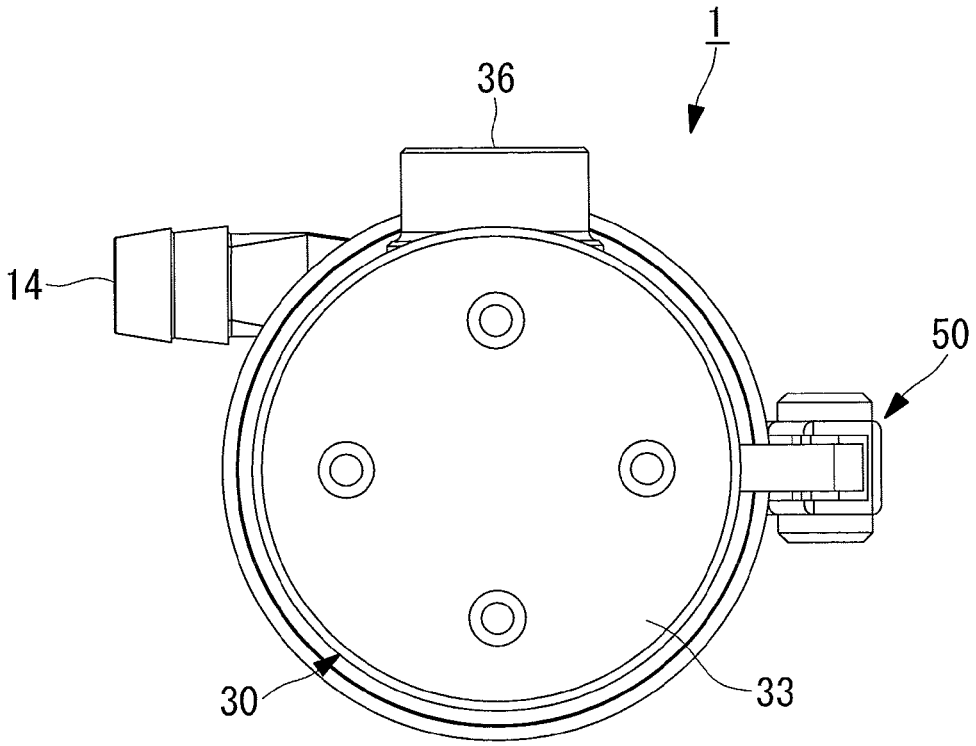
FIG. 4 is a bottom view of FIG. 2.
Figure 5:
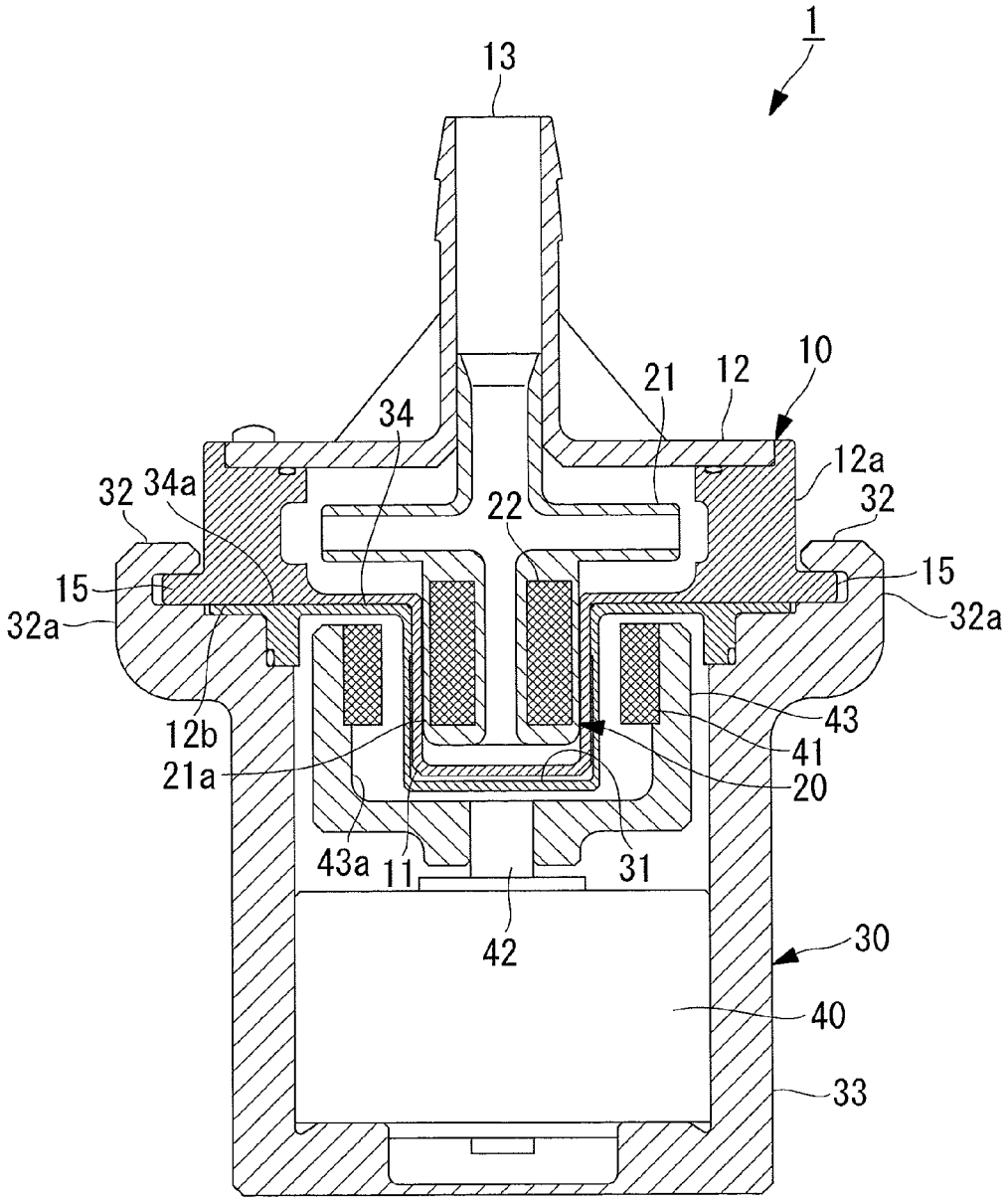
FIG. 5 is a cross-sectional view of FIG. 3 along B-B.

Hereinafter, an embodiment of a pump configuration according to the present invention will be described based on the drawings.

A pump configuration of an embodiment shown in FIGS. 1 to 7 (a first example) is a pump configuration of a centrifugal pump. A centrifugal pump 1 shown in the drawings is called a coupling type where integration is achieved by inserting a convex portion 11 provided on the bottom surface of a pump unit 10 into a concave portion 31 provided on the top surface of a drive motor unit 30. In this case, the cross-sectional shapes of the convex portion 11 and the concave portion 31 are true circles of substantially the same diameter.

Furthermore, the centrifugal pump 1 described above is, as shown in FIGS. 5 and 6, for example, a magnetic drive pump configuration according to which an impeller 21 is rotated to apply pressure on liquid by magnetic force between an inner magnet 22, which is a driven magnet attached to the impeller 21 that rotates by a hydrodynamic bearing 20, which is a non-contact bearing, inside the pump unit 10 and an outer magnet 41, which is a driving magnet, that is rotated inside the drive motor unit 30 by a motor 40. That is, the magnetic drive centrifugal pump 1 is configured such that the motor 40 and the impeller 21 are not coupled, and between the pump unit 10 and the drive motor unit 30 can be completely separated.

The pump unit 10 includes a fluid inlet 13 and a fluid outlet 14 formed in a resin casing 12. The casing 12 which is shown in the drawing is configured by combining two main parts to accommodate and install the impeller 21.

The hydrodynamic bearing 20 that supports the impeller 21 in a rotatable manner is configured to have a shaft portion 21*a* that is provided in a protruding manner from the bottom surface of the impeller 21 fitted in a hollow cylindrical portion formed inside the convex portion 11 of the casing 12, and by appropriately setting a fitting dimensional tolerance, the impeller 21 is made to float by the dynamic pressure of fluid and to rotate in a non-contact state. Additionally, the inner magnet 22 mentioned above is fixed inside the shaft portion 21*a* of the impeller 21 and is accommodated and installed.

A plurality of claws 15 that engage with engaging portions 32, described later, on the drive motor unit 30 side are provided, outward and in a protruding manner, on an outer circumferential surface of the pump unit 10, or more specifically, on a side wall surface 12*a* of the casing 12. The claw 15 is a horizontal plate portion which is substantially rectangular in planar view, and in the example configuration shown in the drawing, three claws 15 are provided in the circumferential direction at a 120 degree pitch, but this is not restrictive.

Also, an engaging protrusion member 51, which is a structural member of a locking mechanism 50 described later, is provided in a protruding manner on the side wall surface 12*a*, which is the outer circumferential surface of the pump unit 10, at a position that does not interfere with the engaging portion 32. The engaging protrusion member 51 is a horizontal plate member that is provided outward and in a protruding manner from the pump unit 10, that is, the side wall surface 12*a* of the casing 12. A guide engagement surface 52 is formed on an outer circumferential edge surface of the engaging protrusion member 51. The guide engagement surface 52 includes a sloping surface 52*a* whose protrusion amount increases in the opposite direction from an attachment rotation direction shown by an arrow R in FIG. 1, and a step 52*b* that is sharply dented inward from the sloping surface 52*a*.

The drive motor unit 30 includes the motor 40 for driving inside an aluminum or resin casing 33 of a substantially cylindrical bottomed form. The motor 40 is accommodated and installed at the bottom of the casing 33. Also, a drive rotor 43 to which the outer magnet 41 is attached is provided to a motor shaft 42 protruding upward.

The drive rotor 43 is a substantially cylindrical bottomed member having the motor shaft 42 coupled to its bottom surface. The outer magnet 41 is attached on an inner circumferential surface 43*a* of the drive rotor 43.

The concave portion 31 is formed on the inner circumferential side of the outer magnet 41 for inserting the convex portion 11 of the pump unit 10, and a resin sealing member 34, forming the casing 33, for sealing a top opening for installing the motor 40 is attached thereto. Additionally, a reference sign 35 in the drawing is a rotation stopper for restriction in the attachment rotation direction R of the pump unit at a predetermined position, and a reference sign 36 is a cable hole.

As a result, when the convex portion 11 of the pump unit 10 is inserted into the concave portion 31 of the drive motor unit 30 up to a predetermined position, the inner magnet 22 will be arranged on the inner circumferential side of the outer magnet 41 in a facing manner across resin members such as the sealing member 34, the casing 33 and the like.

At an upper outer circumferential portion of the drive motor unit 30 described above, three engaging portions 32 arranged at a 120 degree pitch in the circumferential direction are provided so as to engage with the claws 15 at predetermined assembly positions when the pump unit 10 is rotated in the attachment rotation direction R.

The engaging portion 32 is a cross-sectionally substantially C-shaped member that forms an engagement surface 32*b* by bending inward an upper end portion of a column portion 32*a* extending in the vertical direction. Accordingly, when the claw 15 rotates together with the pump unit 10, the thick part of the claw 15 enters the cross-sectionally C-shaped part of the engaging portion 32, and the upward movement of the claw 15 and the pump unit 10 is restricted. In this case, a thickness t of the claw 15 is set to be substantially equal to or somewhat greater than a height h of the engaging portion 32 such that the resin claw 15 is press fitted into the resin engaging portion 32 and a play is prevented.

Furthermore, the centrifugal pump 1 described above includes the locking mechanism 50 for holding the pump unit 10 at an engagement position of the claw 15 and the engaging portion 32.

The locking mechanism 50 includes the engaging protrusion member 51 described above on the outer circumferential edge surface protruding outward from the pump unit 10. The guide engagement surface 52 formed from the sloping surface 52*a*, whose protrusion amount increases in the opposite direction from the attachment rotation direction R, and the step 52*b* is formed on the engaging protrusion member 51.

Moreover, the locking mechanism 50 includes a movable arm 53 which is attached on the outer circumferential surface of the drive motor unit 30.

The movable arm 53 includes an arm main body 54 that is supported, at around the middle portion, on the outer circumferential surface of the casing 33 and that is capable of swinging in a pump radial direction, an elastic member, not shown, that biases inward the upper end portion of the arm main body 54 in the pump radial direction, a concave portion 55 that is provided on the upper end portion side of the arm main body 54 and that engages with the engaging protrusion member 51, and a guide wall 56 that causes the arm main body 54 to swing by coming into contact with the sloping surface 52*a* and that acts as a detent for the pump unit 10 by engaging with the step 52*b*. That is, the movable arm 53 is supported by a pin 57 and is swingable in the pump radial direction on a vertical plane, and normally, a pressure is applied on an inner circumferential tip end of the concave portion 55 toward the side wall surface 12*a* of the pump unit 10 by the bias of the elastic member.

By providing such a locking mechanism 50, when the pump unit 10 whose convex portion 11 is inserted into the concave portion 31 of the drive motor unit 30 is rotated in the attachment rotation direction R, the arm main body 54 whose guide wall 56 is in contact with the sloping surface 52*a* is made to move along the sloping surface 52*a* whose protrusion amount increases in the opposite direction from the attachment rotation direction R. Thus, the bias of the elastic member is overwhelmed, and the guide wall 56 is pushed outward.

As a result, the movable arm 53 is opened outward, overwhelming the bias of the elastic member, and then, when the guide wall 56 passes the sloping surface 52*a* and reaches the step 52*b*, the movable arm 53 is automatically closed inward by the bias of the elastic member. Then, the engaging protrusion member 51 enters the concave portion 55, and the step 52*b* and the guide wall 56 are engaged. That is, at the time of assembling the pump unit 10 and the drive motor unit 30, the locking mechanism 50 automatically operates without the movable arm 53 being operated, and a state is achieved where the pump unit 10 is restricted from rotating in the opposite direction from the attachment rotation direction R.

If the stopper 35 for restricting the rotation in the attachment rotation direction R is provided as necessary, as shown in FIG. 1, for example, the pump unit 10 is prevented from moving in the attachment rotation direction R or in the opposite direction when the locking mechanism 50 has been operated.

The centrifugal pump 1 configured in the above manner is positioned in the thrust direction in a state where the convex portion 11 is inserted up to a predetermined position in the concave portion 31, by having a bottom surface of the pump unit 10 (a bottom surface 12*b* of the casing 12) and a top surface of the drive motor unit 30 (a top surface 34*a* of the sealing member 34 forming the casing 33) in surface contact with each other. Also, positioning in the radial direction is achieved when the outer circumferential surface of the convex portion 11 and the inner circumferential surface of the concave portion 31, both shaped as a true circle in a cross-section, come into contact with each other.

In this case, the fitting dimensional tolerance allowed between the convex portion 11 of the pump unit 10 and the concave portion 31 of the drive motor unit 30 is set to be smaller (stricter) than the fitting dimensional tolerance of the hydrodynamic bearing 20 accommodated inside the pump unit 10 so as to prevent shaft misalignment of the hydrodynamic bearing 20. That is, if the fitting dimensional tolerance between the convex portion 11 and the concave portion 31 is smaller than for the hydrodynamic bearing 20, since the rotation of the impeller 21 is specified by the fitting dimensional tolerance of the hydrodynamic bearing 20, smooth rotation of the impeller 21 is not prevented by the engagement of units.

Then, when the pump unit 10 is rotated in the attachment rotation direction R from a state where the convex portion 11 of the pump unit 10 and the concave portion 31 of the motor drive unit 30 are engaged, that is, when it is rotated until any one of the claw 15 abuts the stopper 35, the claws 15 at three positions enter the corresponding concave portions 31 of the engaging portion 32, and the upward movement is restricted. As a result, the pump unit 10 is retained to the drive motor unit 30 with respect to the thrust direction.

Moreover, at the same time as such retention, the locking mechanism 50 automatically operates to restrict the rotation of the pump unit 10. In this locked state, the movable arm 53 is biased inward in the pump radial direction by the elastic member, and also, the engaging protrusion member 51 is engaged with the concave portion 55, and thus, the pump unit 10 will not come off the drive motor unit 30 unless an operator intentionally releases the locked state of the movable arm 53. Additionally, at the time of releasing the locking mechanism 50, the arm main body 54 may be opened by moving outward the upper end portion side by pressing the lower end portion side of the arm main body 54 inward against the bias of the elastic member and by using the pin 57 as a fulcrum.

Now, an assembly procedure for attaching the pump unit 10 to the drive motor unit 30 and integrating the two will be concretely described.

First, the convex portion 11 of the pump unit 10 is vertically inserted into and attached to the concave portion 31 of the drive motor unit 30. At this time, if the locking mechanism 50 is left disengaged, that is, if the lower end portion side of the arm main body 54 is pressed inward and engagement with the engaging protrusion member 51 is left released, the movable arm 53 will not interfere with the pump unit 10.

Next, the pump unit 10 is rotated in the attachment rotation direction R, and the claw 15 of the pump unit 10 is made to coincide with the engaging portion 32. As a result, the claw 15 enters the cross-sectionally C-shaped part of the engaging portion 32, and the upward movement is prevented by the engagement surface 32*b*. By rotating the pump unit 10 to a predetermined position, for example, until it abuts the stopper 35, the pump unit 10 and the drive motor unit 30 are positioned with respect to the thrust direction and the radial direction.

At the same time as the positioning, the locking mechanism 50 automatically operates by the guide wall 56 moving along the sloping surface 52*a*, and the pump unit 10 is secured against rotating.

As a result, the pump unit 10 is positioned and fixed with respect to the drive motor unit 30 in all of the thrust direction, the radial direction and the rotation direction.

On the other hand, when removing the pump unit 10, that is, when an operator intentionally separates the pump unit 10 from the drive motor unit 30, an operation of pressing in the movable arm 53 has to be performed, and a configuration is achieved where an erroneous operation is not easily performed.

The positional relationship between the fluid outlet 14 and the cable hole 36 may be adjusted as appropriate based on the arrangement of the claw 15 and the engaging portion 32, or the arrangement of the locking mechanism 50.

Furthermore, to improve the operability at the time of attachment or detachment of vertically inserting or pulling out the convex portion 11 of the pump unit 10 into or from the concave portion 31 of the drive motor unit 30, that is, to enable smooth attachment/detachment operation, an air passage for causing air to circulate at the time of attachment or detachment is preferably provided between the convex portion 11 and the concave portion 31. As the air passage, a groove or the like provided, for example, on a wall surface of the convex portion 11 or the concave portion 31 in the insertion direction is effective. In other words, no limitation is imposed as long as a passage is formed that can smoothly exhaust air inside the concave portion 31 at the time of mounting the pump unit 10 or that allows air to smoothly enter the concave portion 31 at the time of detaching the pump unit 10.

Figure 6:
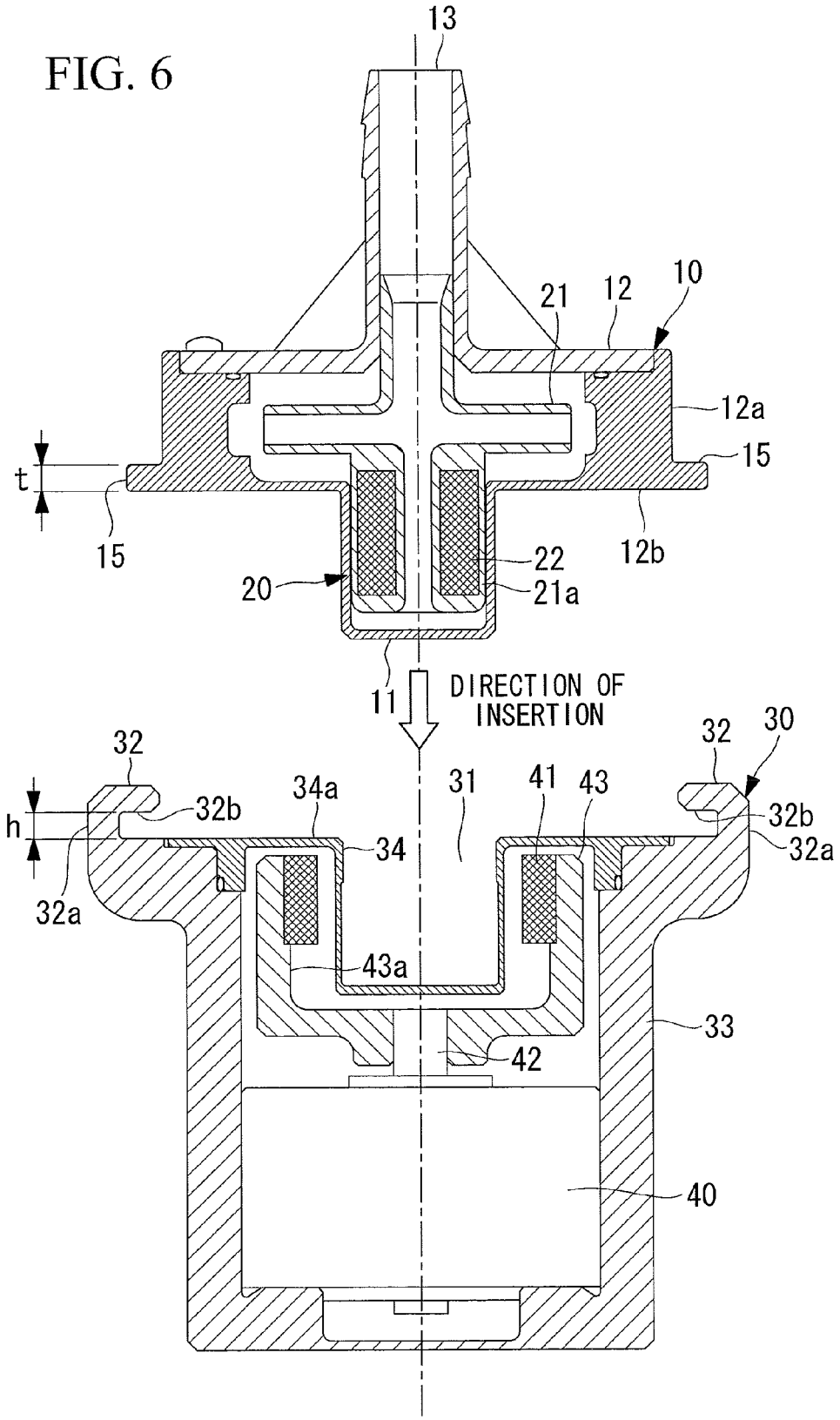
FIG. 6 is a cross-sectional view showing a state before insertion of a pump unit into a concave portion of a drive motor unit.
Figure 7:
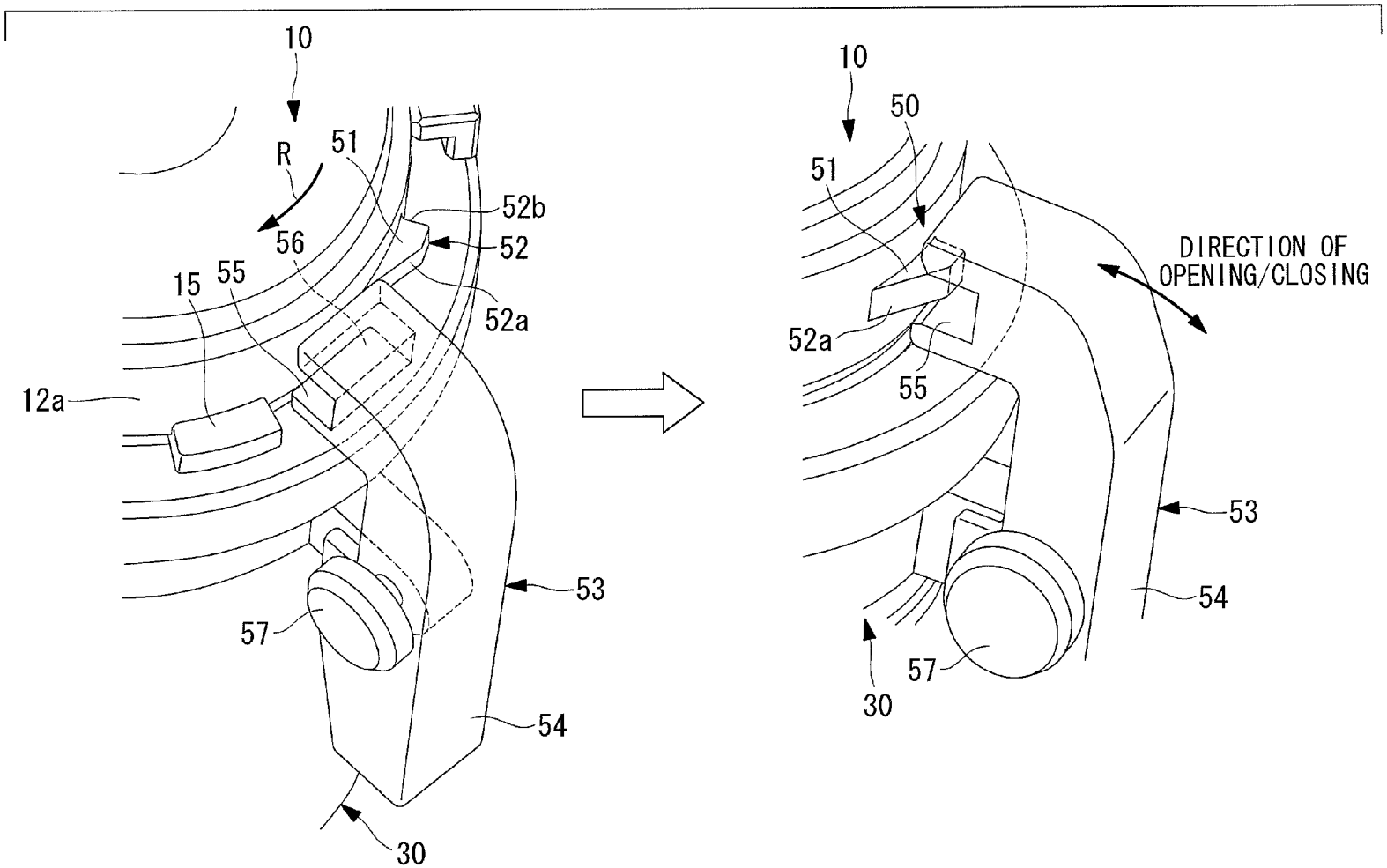
FIG. 7 is an explanatory view showing a fixation operation of a clamp by the rotation of a pump unit inserted into a concave portion of a drive motor unit, and is a perspective view showing a state before fixation by the clamp (left side on the page) and a state after completion of fixation (right side on the page).

Moreover, as shown in FIG. 6, if the opening size of only the upper part of the side wall of the concave portion 31 is made small and the opening size of the lower part of the side wall is made larger than the upper part, a malfunction that the hydrodynamic bearing of the drive motor unit fails to function can be prevented.

As described, according to the pump configuration of the embodiment described above, when the pump unit 10 is rotated with the convex portion 11 inserted into the concave portion 31 of the drive motor unit 30, the pump unit 10 and the drive motor unit 30 are positioned with respect to the thrust direction and the radial direction, and also, the locking mechanism 50 automatically operates to apply a detent and fix the pump unit 10, and thus, the magnetic-drive coupling pump configuration is provided with an attachment/detachment mechanism capable of simply, reliably and swiftly performing positioning and fixation.

Moreover, the pump configuration of the embodiment described above also has an advantage that, by having a simple structure, the number of parts can be reduced and the cost can be lowered.

Furthermore, accurate positioning in both the thrust direction and the radial direction increases the rotational accuracy of the impeller 21, and is effective for improving the performance of a non-contact bearing, such as the hydrodynamic bearing 20 or a magnetic bearing, thereby significantly facilitating manufacturing and quality management. Also, in the case a pivot bearing or a sealed bearing is used, its durability can be effectively increased.

Moreover, since the pump unit 10 may be reliably fixed, positioning accuracy is not impaired due to vibration at the time of pump operation or the like, and unexpected separation or malfunction of the pump unit 10 is less likely to occur, and also, separation of the pump unit 10 due to improper use by an operator or due to carelessness may be prevented, and thus, risk regarding poor fixation can be reduced.

Also, since assembly can be achieved even in a situation where swift exchange of pumps is required by swiftly and reliably attaching the pump unit 10, application to a heart-lung device or the like used in an emergency is also made possible, for example.

Furthermore, with the pump unit 10 of the present embodiment, when using the same in a heart-lung device, for example, to enable immediate use in an operating room, the pump unit 10 is preferably sterilized by ethylene oxide gas at 80 degrees without being sterilized in an autoclave before use, and then, filled with saline with no dissolved oxygen by depressurization or increase in the temperature, and sealed by having seals or coupling units connected to the fluid inlet 13 and the fluid outlet 14 of the pump unit 10.

Furthermore, air tends to be collected at the hydrodynamic bearing 20 or in a space below a shaft at the time of filling the pump unit 10 with saline, but if the saline is injected while rotating the shaft portion 21*a*, this will eliminate any remaining air pockets, and it is therefore preferable that saline is injected while rotating the shaft portion 21*a*.

Similarly, also at the time of exhausting the ethylene oxide gas, if the gas is replaced by air while the shaft portion 21*a* is being rotated, an advantage that the replacement time can be shortened can be achieved.

In a pre-priming procedure, when sterilizing the pump unit 10 by ethylene oxide gas at 80 degrees, since a neodymium magnet is demagnetized at a high temperature of about 80 degrees, it is preferable that Dy is added by about one percent to raise the demagnetization temperature, or the demagnetization value is taken into account with respect to the magnetization amount, or an SmCo magnet whose demagnetization temperature is higher than that of the neodymium magnet is used.

Furthermore, since the neodymium magnet is mainly made of Fe and is easily rusted, it is often coated with Ni metal, but to increase the reliability, it is preferably entirely covered by resin such as high density polyethylene.

Figure 8:
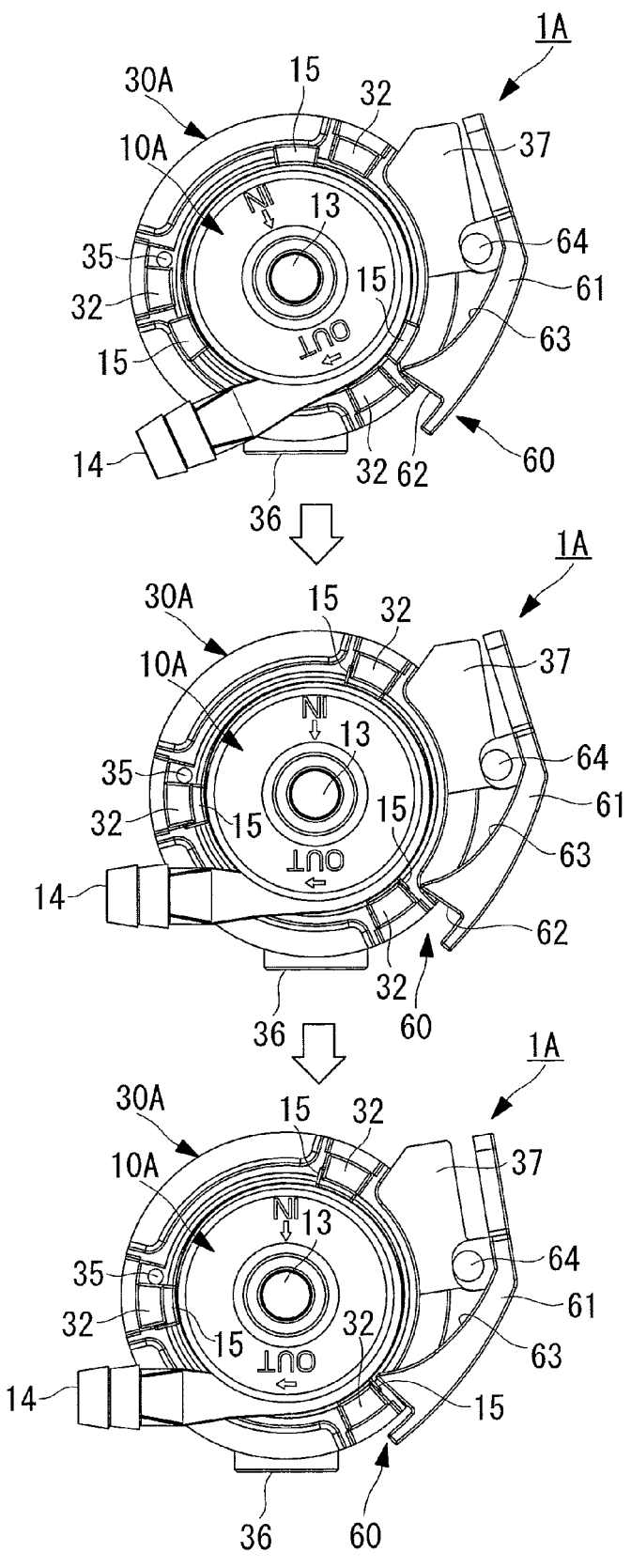
FIG. 8 is a view showing an embodiment (a second example) of the pump configuration according to the present invention, and is a plan view showing an operation procedure of a locking mechanism reaching a locked state according to the rotation of a pump unit.
Figure 9:
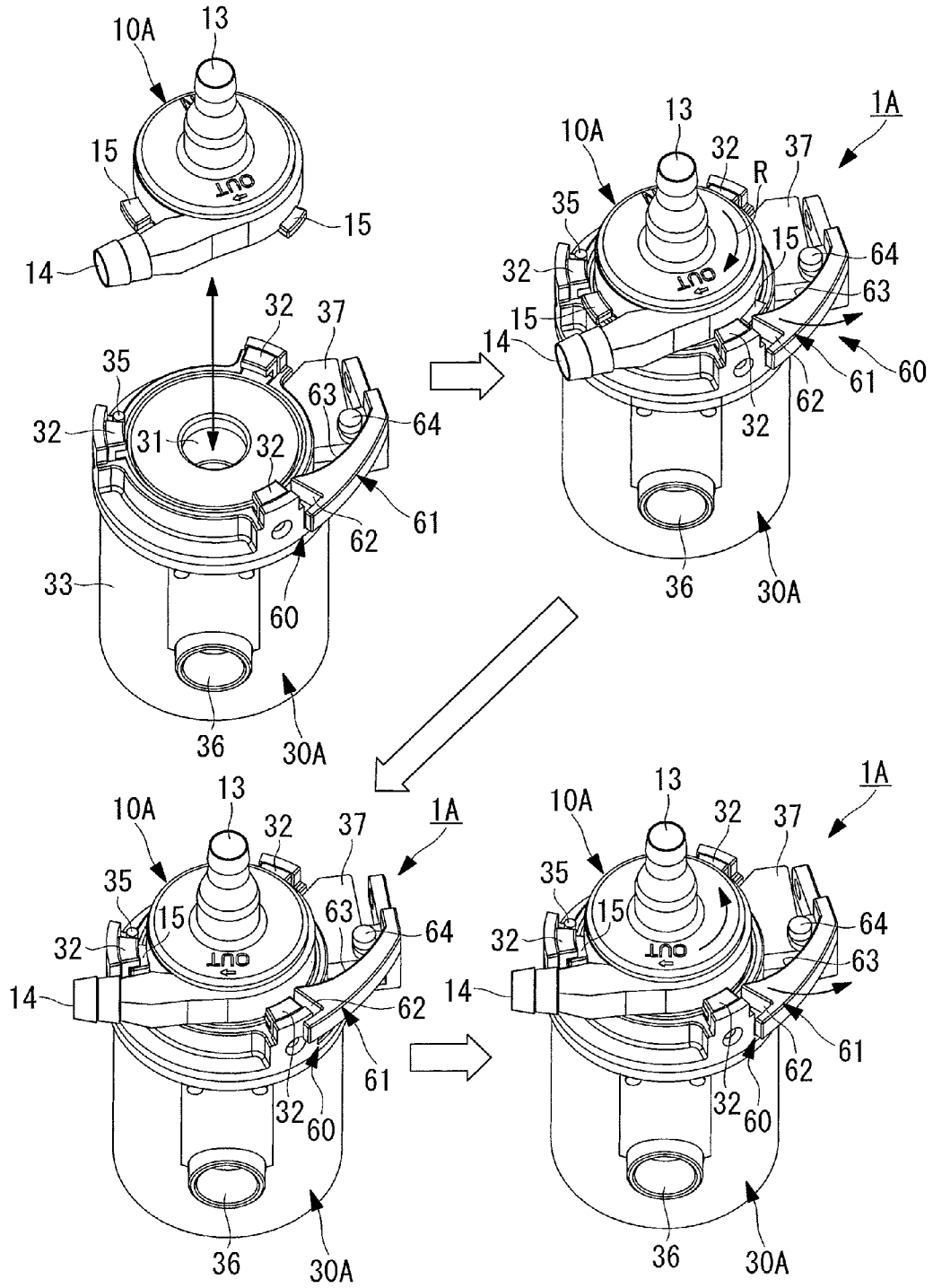
FIG. 9 is a perspective view showing, with respect to the pump configuration of the second example, in a sequential manner, from a state before assembly where a pump unit and a drive motor unit are not yet integrated up to a state after assembly where they are integrated.

Next, another embodiment (a second example) of the pump configuration according to the present invention will be described based on FIGS. 8 to 10. Additionally, in the following description, parts that are the same as those in the embodiment described above will be denoted with the same reference signs, and detailed description thereof will be omitted.

A centrifugal pump 1A of the second example adopts a locking mechanism 60 whose engaging tip end portion side is constructed to be swingable in a pump radial direction on a horizontal plane, instead of the locking mechanism 50 which is swingable in the pump radial direction on a vertical plane.

The locking mechanism 60 includes an arm main body 61 that is swingable on a horizontal plane, an elastic member (not shown) that biases the arm main body 61, an engaging surface 62 that is provided at an engaging tip end portion side of the arm main body 61, and a guide surface 63 that causes the engaging tip end portion side of the arm main body to swing outward in the pump radial direction.

The arm main body 61 is a member that is bent in a substantially V-shape in planar view. The arm main body 61 is a movable arm that is supported by a pin 64, at around the middle (bent) portion, on a base 37 provided in a protruding manner from an outer circumferential surface of a drive motor unit 30A, and that is swingable around the pin 64 on a horizontal plane.

Furthermore, the arm body 61 is biased toward one direction of swing by an elastic member such as a torsion coil spring, for example. That is, one end of the arm member 61 is biased inward in the pump radial direction, and is pressed toward the outer circumferential surface of the pump unit 10A.

An engaging surface 62 is obtained by widening one end of the arm main body 61 and providing a step. That is, the engaging surface 62 that acts as a detent in the opposite direction of an attachment rotation direction R of the pump unit 10A is provided at a tip end side of the arm main body 61 that is biased inward by the elastic member in the pump radial direction and pressed toward the outer circumferential surface of the pump unit 10A. The engaging surface 62 is a surface that substantially coincides with the radial direction of the pump unit 10A, and is substantially the same in height as a claw 15 and an engaging portion 32 in a state where a convex portion 11 of the pump unit 10A is inserted into a concave portion 31 of the drive motor unit 30A.

In the following description, the tip end side of the arm main body 61 provided with the engaging surface 62 will be referred to as an engaging tip end portion side, and the other end side of the arm main body 61 will be referred to as a release lever side.

The guide surface 63 is a curved surface formed on the inner circumferential surface of the arm main body 61 (on the surface facing the outer circumferential surface of the pump unit 10A), and is a sloping surface that contacts the claw 15 at the time of attachment/rotation of the pump unit 10A and causes the engaging tip end portion side of the arm main body 61 to move (swing) outward in the pump radial direction. The guide surface 63 is formed between the pin 64 and the engaging surface 62. In the example configuration shown in the drawing, the guide surface 63 is a curved guide surface 63 whose engaging tip end portion side is wide and protrudes toward the outer circumferential surface of the pump unit 10A, and the value of whose width (the amount of protrusion) is continuously (gradually) decreased in the direction opposite the attachment rotation direction R of the pump unit 10A.

That is, the curved guide surface 63 is formed on the inner circumferential side of the arm main body 61 with the arm width increasing in the direction of the engaging surface 62 from the pin 64 side, which is the center of swinging, and the arm width abruptly decreases at the engaging surface 62 formed at the engaging tip end portion side to form a step in the pump radial direction.

The centrifugal pump 1A including such a locking mechanism 60 is assembled by rotating the pump unit 10A whose convex portion 11 is inserted into the concave portion 31 of the drive motor unit 30A in the clockwise attachment rotation direction R. At this time, the arm main body 61 whose guide surface 63 is in contact with the claw 15 has the guide surface 63 pushed outward and the engaging tip end portion side moved outward in the pump radial direction.

As a consequence, the arm main body 61 overwhelms the bias of the elastic member and opens outward on a horizontal plane. In other words, the arm main body 61 opens outward on a horizontal plane under the pressure of the claw 15, which is stronger than the bias of the elastic member.

When the pump unit 10A rotates to a predetermined position in this manner, another claw 15 abuts a stopper 35, and also, the claw 15 passes the guide surface 63 and reaches the engaging surface 62. The arm main body 61 is therefore disengaged from the engagement with the claw 15, and is closed inward by the bias of the elastic member.

By the rotational operation of the pump unit 10A and the operation of the arm main body 61 described above, the locking mechanism 60 achieves a detent with the engaging surface 62 of the arm main body 61 supported to the drive motor unit 30A side and the claw 15 on the pump unit 10A side being engaged at a predetermined assembly position where the claw 15 and the engaging portion 32 are engaged. As a result, the pump unit 10A is prevented by the stopper 35 from rotating in the attachment rotation direction R and by the engaging surface 62 from rotating in the opposite direction from the attachment rotation direction R, and thus, falls into a locked state where it is held at a predetermined assembly position where it is not allowed to rotate in either direction.

Then, in this locked state, as in the embodiment described above, the engaging tip end portion side of the arm main body 61 is biased inward in the pump radial direction by the elastic member and the upward movement of the pump unit 10A is restricted by the engagement of the claw 15 and the engaging portion 32, and thus the pump unit 10A is not removed from the drive motor unit 30A unless an operator intentionally releases the locked state of the arm main body 61.

As for the operation of lock releasing, the outer circumferential surface on the release lever side of the arm main body 61 is pressed inward in the pump radial direction, and the engaging tip end portion side is rotated outward in the pump radial direction.

Figure 10:
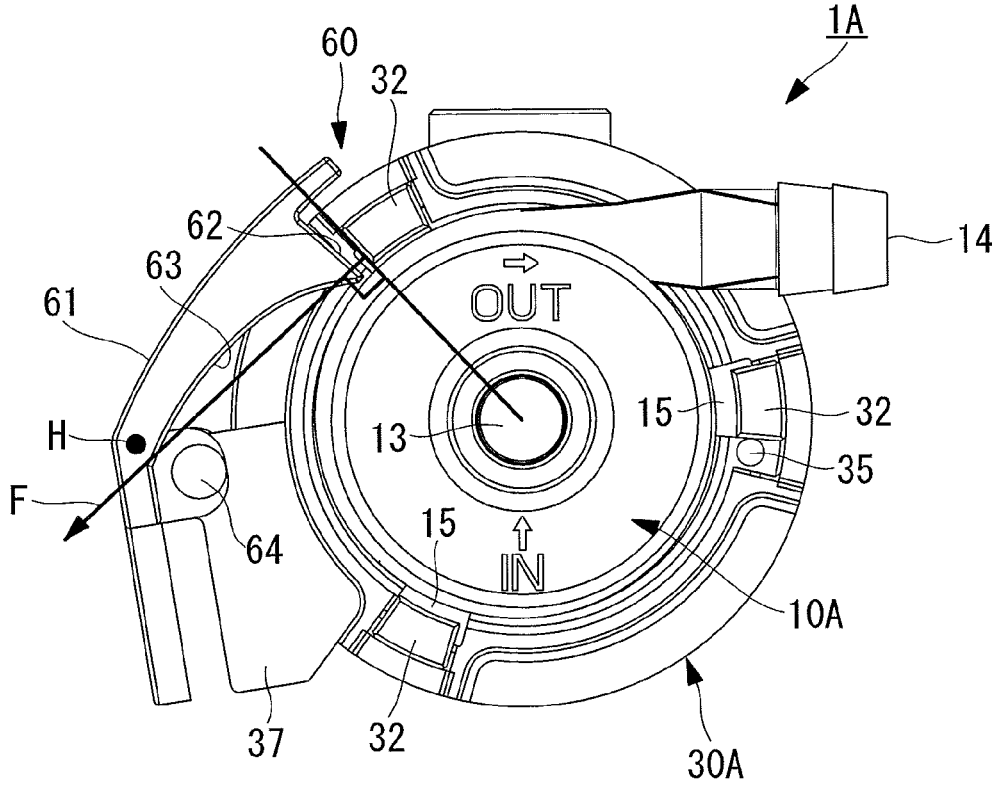
FIG. 10 is a plan view for describing, with respect to a locking mechanism of the pump configuration shown in FIG. 8, an action of a movable arm moving inward at the time of a pump unit rotating in the opposite direction.

Furthermore, as shown in FIG. 10, for example, if a hinge H, which is a fulcrum for bending deformation of the arm main body 61, is outside of a tangential force F, inward force in the pump radial direction acts on the engaging tip end portion side at the time of rotating the pump unit 10A in the opposite direction from the attachment rotation direction R in a predetermined assembly state. Thus, if the pump unit 10A is simply rotate in the opposite direction from the attachment rotation direction R, this operation is in the opposite direction from the releasing of the locking mechanism 60, and lock is not released unless the lock releasing operation described above is performed.

Figure 11:
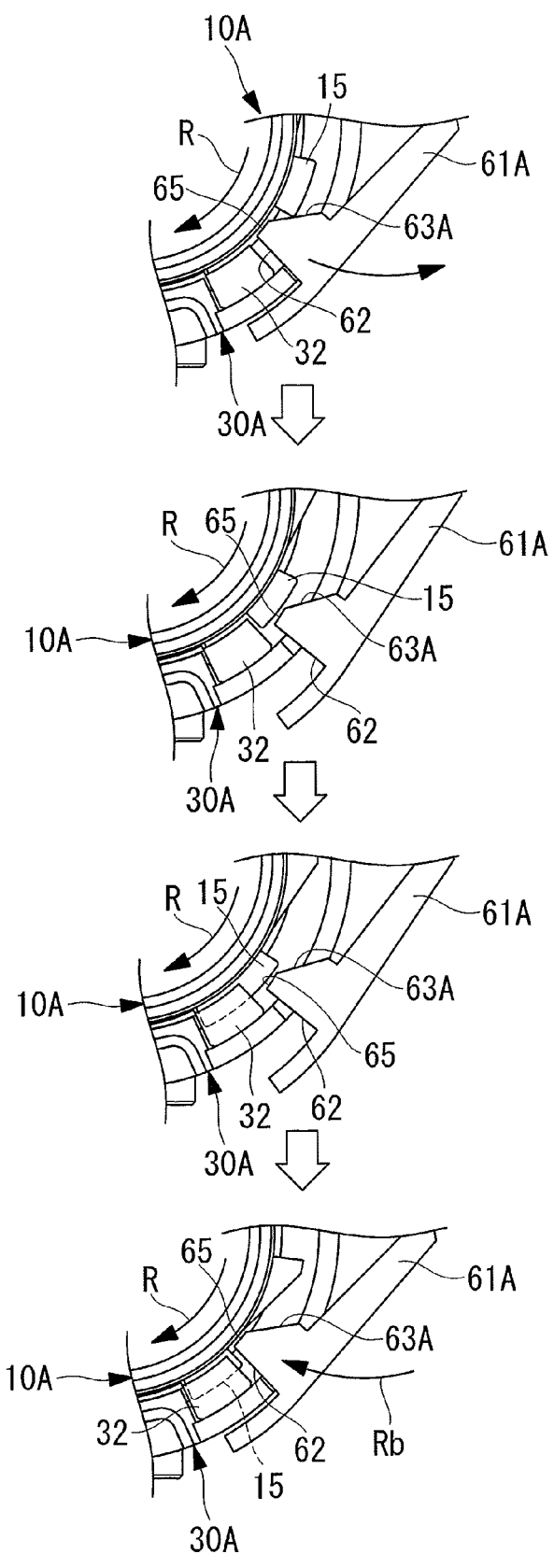
FIG. 11 is a view showing a modified example of the second example.

Moreover, the guide surface 63 described above is a curved surface formed on the inner circumferential surface of the arm main body 61, but as shown as a modified example in FIG. 11, an arm main body 61A may include a guide surface 63A, which is a straight sloping surface. Additionally, the guide surface 63A shown in the drawing includes a flat surface 65 between itself and an engaging surface 62, but the straight sloping guide surface may start immediately from the engaging surface 62.

According to the configuration of the modified example, when a pump unit 10A is rotated in an attachment rotation direction R, a claw 15 contacts the guide surface 63A and the arm main body 61A is thereby pushed outward. The pump unit 10A is thereby allowed to rotate in the attachment rotation direction R. Then, when the pump unit 10A rotates to a predetermined position, another claw 15 abuts a stopper 35, and the claw 15 passes the guide surface 63 and reaches the engaging surface 62.

Accordingly, the arm main body 61A is closed inward by the bias of an elastic member by being disengaged from the engagement with the claw 15, and as a result, the pump unit 10A is prevented by the engaging surface 62 and the stopper 35 from rotating in either direction.

As described, according to the pump configuration of the second example described above, when the pump unit 10A is rotated with the convex portion 11 inserted into the concave portion 31 of the drive motor unit 30A, the pump unit 10A and the drive motor unit 30A are positioned with respect to the thrust direction and the radial direction, and also, the locking mechanism 60 automatically operates to apply a detent and fix the pump unit 10A, and thus, the magnetic-drive coupling pump configuration is provided with an attachment/detachment mechanism capable of simply, reliably and swiftly performing positioning and fixation.

Moreover, the pump configuration of the second example described above also has an advantage that, by having a simple structure, the number of parts can be reduced and the cost can be lowered.

Additionally, the present invention is not limited to the embodiments described above, and it may be appropriately modified without departing from the spirit of the invention; for example, no limitation is imposed with respect to the fluid to be treated.

{Reference Signs List}

1, 1A Centrifugal pump
10, 10A Pump unit
11 Convex portion
12, 33 Casing
12*a* Side wall surface
13 Fluid inlet
14 Fluid outlet
15 Claw
20 Hydrodynamic bearing (Non-contact bearing)
21 Impeller
21*a* Shaft portion
22 Inner magnet (Driven magnet)
30, 30A Drive motor unit
31 Concave portion
32 Engaging portion
34 Sealing member
35 Stopper
37 Base
40 Motor
41 Outer magnet (Driving magnet)
42 Motor shaft
43 Drive rotor
43*a* Inner circumferential surface
50, 60 Locking mechanism
51 Engaging protrusion member
52 Guide engagement surface
52*a* Sloping surface
52*b* Step
53 Movable arm
54, 61, 61A Arm main body
55 Concave portion
56 Guide wall
57, 64 Pin
62 Engaging surface
63, 63A Guide surface
65 Flat surface

The invention claimed is:

1. A magnetic drive pump configuration which is of a coupling type that inserts a convex portion provided on a bottom surface of a pump unit into a concave portion provided on a top surface of a drive motor unit to achieve integration, and according to which magnetic force generated between a driven magnet attached to an impeller that rotates by a non-contact bearing inside the pump unit, and a driving magnet that rotates by a motor inside the drive motor unit, rotates the impeller and applies pressure on liquid, wherein positioning in a thrust direction is achieved by the bottom surface of the pump unit and the top surface of the drive motor unit that are in surface contact with each other in a state where the convex portion is inserted up to a predetermined position in the concave portion, and positioning in a radial direction is achieved by a contact between an outer circumferential surface of the convex portion and an inner circumferential surface of the concave portion, wherein the pump configuration comprises a plurality of claws provided in a protruding manner on an outer circumferential surface of the pump unit, a plurality of engaging portions provided in an upwardly protruding manner from an upper outer circumferential portion of the drive motor unit to restrict upward movement of the claws by coming into engagement when the pump unit is rotated into a state where the convex portion is inserted up to the predetermined position in the concave portion, and a locking mechanism for holding the pump unit at an engagement position of the claws and the engaging portions, and wherein the locking mechanism includes an engaging protrusion member having a guide engagement surface, formed on an outer circumferential edge surface protruding outward from the pump unit, that is formed as a sloping surface whose protrusion amount increases in an opposite direction from an attachment rotation direction in order to form a step, and a movable arm having an arm main body that is supported, at a middle portion, on an outer circumferential surface of the drive motor unit and that can swing in a pump radial direction on a vertical plane, an elastic member that biases inward an upper end portion side of the arm main body in the pump radial direction, a concave portion that is provided at the upper end portion side of the arm main body and that engages with the engaging protrusion member, and a guide wall that causes the arm main body to swing by contacting the sloping surface and that applies a detent on the pump unit by engaging with the step.

2. The pump configuration according to claim 1, wherein the locking mechanism includes a stopper that restricts the rotation of the pump unit in the attachment rotation direction.

3. The pump configuration according to claim 1, wherein a passage is provided between the convex portion provided on the bottom surface of the pump unit and the concave portion provided on the top surface of the drive motor unit, to cause air to circulate at a time of attachment/detachment.

4. The pump configuration according to claim 1, wherein a fitting dimensional tolerance allowed between the convex portion of the pump unit and the concave portion of the drive motor unit is set to be smaller than a fitting dimensional tolerance for the non-contact bearing accommodated inside the pump unit.

* * * * *